United States Patent [19]

Steuer et al.

[11] Patent Number: 4,664,338

[45] Date of Patent: May 12, 1987

[54] PROJECTILE HAVING EXTENDABLE WINGS

[75] Inventors: Raimar Steuer, Rothenbach; Bernd Brieseck, Henfenfeld, both of Fed. Rep. of Germany

[73] Assignee: Diehl GmbH & Co., Nuremberg, Fed. Rep. of Germany

[21] Appl. No.: 772,247

[22] Filed: Sep. 3, 1985

[51] Int. Cl.[4] ..... F42B 13/32; B64C 3/56

[52] U.S. Cl. ..... 244/328; 244/49

[58] Field of Search ..... 244/3.27, 3.26, 3.28, 244/3.29, 49, 218, DIG. 1.2; 108/48, 134; 297/146

[56] References Cited

U.S. PATENT DOCUMENTS

| | | | |
|---|---|---|---|
| 1,339,188 | 5/1920 | Frecska | 244/3.27 |
| 3,507,150 | 4/1970 | Stengel | 244/49 |
| 3,743,218 | 7/1973 | Sweeney et al. | 244/49 |
| 4,351,499 | 9/1982 | Maudal et al. | 244/3.27 |
| 4,586,681 | 5/1986 | Wedertz et al. | 244/3.27 |

*Primary Examiner*—Deborah L. Kyle
*Assistant Examiner*—Michael Carone
*Attorney, Agent, or Firm*—Scully, Scott, Murphy & Presser

[57] ABSTRACT

A projectile possessing extendable wings or fins which are adapted to be pivoted radially outwardly of the projectile. The wing or fin includes a flexible covering and a tensioning device; for example, a strut arrangement, and with the wing or fin being displaceable from a retracted position prior to launch of the projectile to an outwardly extended position in which the applicable covering portion is tensioned by the tensioning device so as to thereby provide a stable, predetermined aerodynamically defined wing or fin configuration.

14 Claims, 7 Drawing Figures

FIG. 4
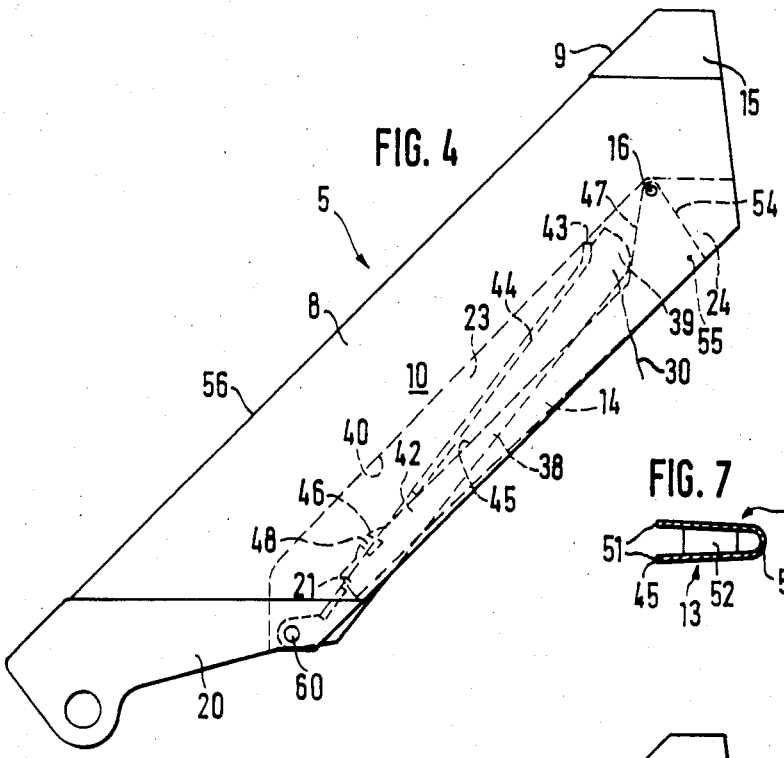
FIG. 7
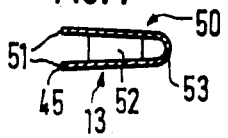
FIG. 5
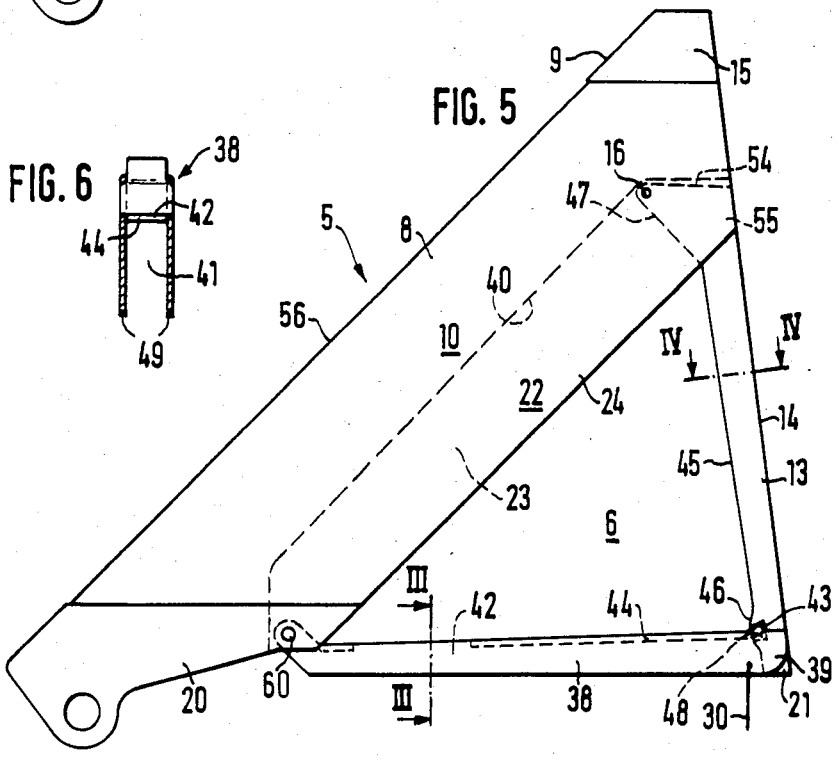
FIG. 6

PROJECTILE HAVING EXTENDABLE WINGS

BACKGROUND OF THE INVENTION

1. Field of the Invention

The present invention relates to a projectile possessing extendable wings adapted to be pivoted radially outwardly of the projectile.

A projectile of that type has been previously proposed for large-calibered barrel-fired ammunition which can be guided by extendable wings or fins during the end phase of its flight. However, it may be advantageous even for slow-flying projectiles having their own propulsion systems, for instance, such as artillery rockets, to improve upon their stability during flight and, consequently, the maneuverability of the projectile through the use of wings of fins which can be extended radially outwardly only subsequent to the launch of the projectile.

2. Discussion of the Prior Art

It has been found to be disadvantageous in previously proposed projectiles incorporating such wings that the aerodynamic efficiency of such wings is limited; each of these wings consist of a covering portion which is fastened to the projectile body itself, and with the covering being primarily tensioned by an internally extended strut arrangement, but with wing shape being determined by the inflating cushioning effect of the oncoming airflow.

SUMMARY OF THE INVENTION

Accordingly, the present invention provides for a projectile incorporating extendable wings or fins, with each wing or fin including a flexible covering and a tensioning device; for example, a strut arrangement, and with the wing or fin being displaceable from a retracted position prior to launch of the projectile to an outwardly extended position in which the applicable covering portion is tensioned by the tensioning device so as to thereby provide a stable, predetermined aerodynamically defined wing or fin configuration.

Pursuant to a further aspect of the present invention there is provided a projectile having wings which can be pivoted outwardly from longitudinal recesses formed in the outer wall structure of the projectile, and wherein, in each instance, the wings comprise a strut arrangement and a covering adapted to be stretched thereby, and in which the covering, rearwardly of the leading edge of the wing, encompasses an aerodynamically profiled rigid nose spar which is hinged so as to be able to be swung forward laterally, with its inner end in or towards the front portion of the longitudinal recess.

The present invention thus provides a projectile which is equipped with space-saving or compact swing-wing structure, in which the aerodynamic wing effect can be constructionally predetermined and constitutes a significant improvement with respect to the practical applications thereof in contrast with current projectiles.

The strut arrangement for stretching the wing covering in the region of the aerodynamically-critical leading edge may incorporate rigid and geometrically particularly configured nose spar. The covering essentially wraps itself around the spar such that the geometry of the self-supporting, and possibly hollow, portion of the wing covering when the wing is pivoted outwardly is predetermined to a considerably extent; in effect is apparently optimized.

In addition, in order to spread the covering when the wing is pivoted outwardly, a rigid profiled rear spar can be hinged to the outer end of the nose spar so as to, with respect to the surroundings of the trailing edge of the wing, constitute a defined cross-sectional geometry. For a small-sized strut arrangement in its retracted position, the rearward portion of the nose spar is preferably designed as a recess which is profiled in a U-shaped configuration open towards the rear. At least a portion of the remainder of the strut arrangement can be pivoted into the cavity when the wing is moved into its retracted position in the projectile body.

For the longitudinal spreading or tensioning of the covering along the longitudinal direction of the projectile, a root or base rib which is divided into two joined parts, and which is extendable through a knee hinge joint may be provided to extend along the body of the projectile; or alternatively the hinge on the base portion of the wing may be omitted to provide a simpler construction and kinematic operation. In the latter case, for stretching or tensioning the wing, merely a unitary rigid rocker arm which is hinged at its front end to the wing nose spar, needs to be pivoted out rearwardly with the nose spar arranged in the outwardly extended position. A free rear end of the rocker arm swings out the rear spar (which is located behind the rocker arm prior to the wing being fully extended), and the rear spar thereby pivots in the opposite sense to the rocker arm as the wing is fully extended (in essence, opposite the direction of flight of the projectile) about its hinge at the outer end of the nose spar and against an elastic restoring force of the thereby stretched covering. Inasmuch as, due to this action of this rocker arm, no hinge is provided along the length thereof, as previously mentioned, the arm can be profiled along its entire length so as to be highly resistant to distortion, with this aspect imparting an additional contribution to the possibility of introducing a force for the stretching of the covering (additional strength) and in the extended position produces a highly distortion-resistant wing.

BRIEF DESCRIPTION OF THE DRAWINGS

Reference is now had to preferred embodiments of the projectile in accordance with the present invention, by way of example, taken in conjunction with the accompanying drawings; in which:

FIG. 4 shows a modified strut arrangement swung in from the rear into a nose spar of the wing, but without the wing covering which is stretched or tensioned thereby;

FIG. 5 shows the strut arrangement pursuant to FIG. 1 in an extended position;

FIG. 6 shows the cross-sectional profile of a rocker arm taken along line III—III in FIG. 5 with transverse dimensions, shown on an enlarged scale; and FIG. 7 shows the cross-sectional profile of the rear spar taken along line IV—IV in FIG. 5.

DETAILED DESCRIPTION

Figure 1:
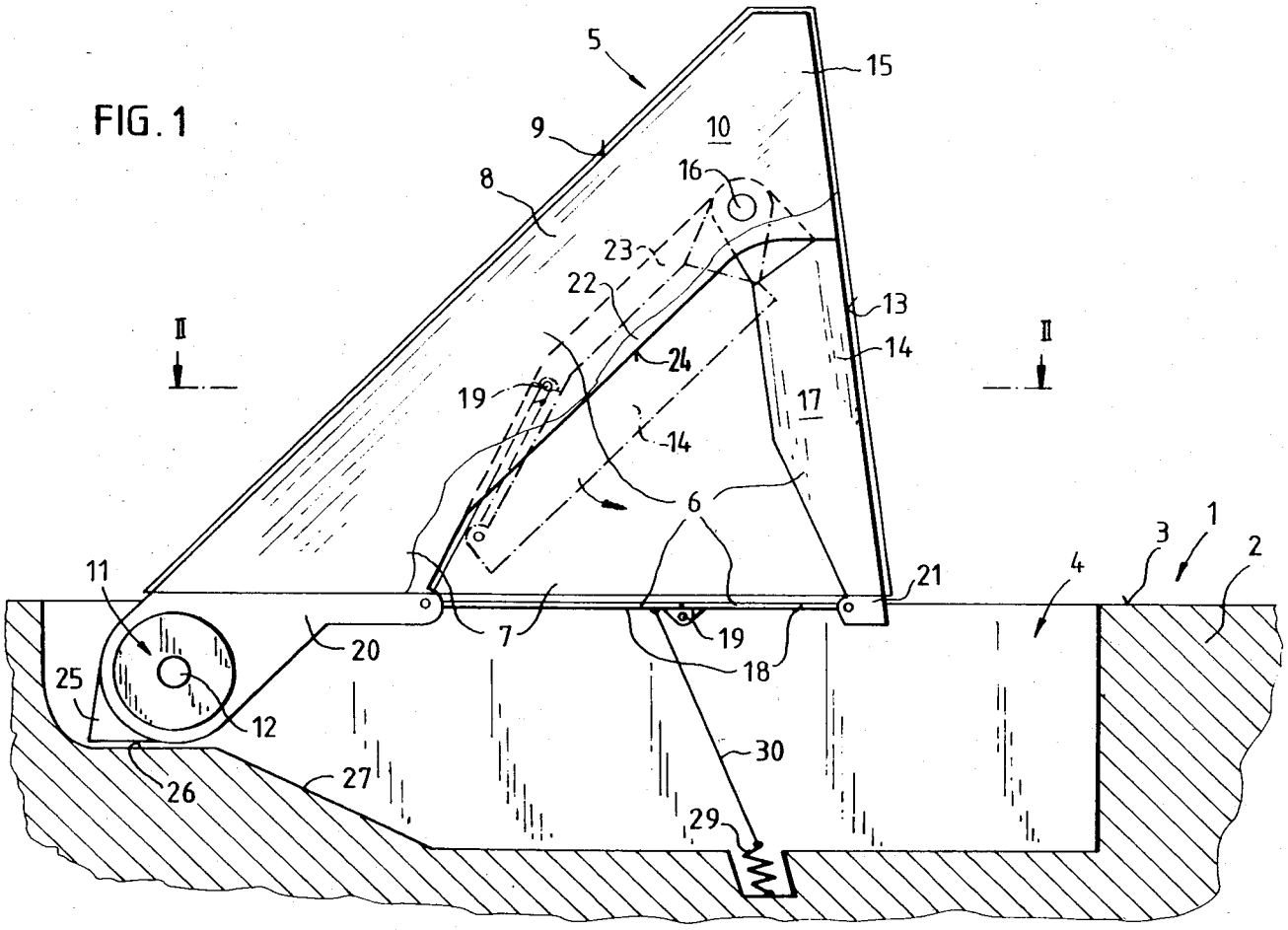
FIG. 1 shows a schematic plan view of a wing or stabilizing fin for a projectile extended radially outwardly into the operational position, and shows the relative orientation of wing parts with a rear spar swung into a retracted position.

A projectile 1 shown in a cut-away longitudinal sectional view in FIG. 1 has formed the periphery of its body 2, offset peripherally along the wall 3 thereof, at least two longitudinal recesses 4 which extend in an approximately axially-parallel orientation along the longitudinal direction of the body 2 (only one recess 4 is shown in the drawing). The longitudinal recesses 4 serve to receive, in each instance, a wing or fin 5 in a folded (retracted) position. The wing or fin 5 consists of a strut arrangement 6, which is encompassed by a covering 7, for example, of sail-cloth, which covering defines the upper and lower wing surface thereof when tensioned in the extended or outwardly pivoted position of the wing 5.

For an aerodynamically favorable cross-sectional profiling of the wing 4 (which is provided in its central portion between the strut arrangement 6 through the tautly stretched covering 7), the strut arrangement 6 has a nose spar 8 which is optimized in its cross-section with respect to the lift factors; the leading edge 9 of the nose spar together with the adjoining wing surfaces 10 are surrounded by tautened covering 7 with the wing in the outwardly pivoted position.

The nose spar 8 is hinged to the fuselage 2 by means of a swivel hinge (pivot) 11 in the front region (view in the direction of flight of the projectile 1) of the longitudinal recess so as to be swingable laterally out beyond the peripheral boundary of the outer wall 3 of the projectile body. For this outward pivoting (extension) movement, adjusting elements, such as a pyrotechnic element or spring-biased elements, possibly with the interposition of gear elements, can be connected in a force-fitted manner (operatively engaged) with a swivel or rocker shaft 12; in order to thereby during a specific flight phase of the projectile, for example, in a time-controlled or program-controlled manner, to pivot (extend) the wing 5 outwardly (initially retracted into its associated longitudinal recess 4), and to thereby ensure a stable flight behavior, suitably, more particularly for control during the end-phase of the flight of the projectile 1 over a specific time interval after firing from a weapon.

A further improvement in flight dynamics can be achieved when there is also provided in the surroundings of the trailing edge 13 a defined aerodynamically optimized cross-sectional geometry of the wing 5. For this purpose, a rigid rear spar 14 which is profiled in an appropriately aerodynamically optimized manner is articulated by means of a hinge pin 16 to the free outer end of the wing 5 (which outer end can be outwardly pivoted). The covering 7 which is subjected to the oncoming air flow thus extends level (smoothly) along the rigidly preset rearward wing surfaces 17 in a geometrically optimized manner. Only in the generally triangular centre region between the two spars 8, 14 and the projectile fuselage 2 does the covering 7 extend in an unsupported manner; in regard to which this orientation is preset by the arching or curvature of the wing surfaces 10, from the leading edge 9 up to inclusive the trailing wing surfaces 17, as a result of which the covering 7 is tautened upon the wing 5 being outwardly pivoted; in effect, is aerodynamically optimized.

Advantageously, in order to ensure uniform tensioning of the covering 7 between the leading edge 9 and the trailing edge 13, a base rib 18 extends along the projectile body 2, which can be retracted or held extended through a knee hinge joint 19. Those parts of the base rib 18 which are respectively located on each side of the knee hinge joint 19, are hinged, on the one hand, in the region of the inner end 20 of the nose spar 8 and oppositely in the region of the inner end 21 of the rear spar 14. It can be suitable to also conduct the covering 7 about this two-part base rib 18; such that all three lateral edges of the triangular wing 15 are then geometrically defined by rigid structural parts, which further improves the capabilities for the aerodynamic optimization of the cross-sectional shape of the wing 5.

Moreover, for unfolding of the base rib 18 about its knee hinge joint 19, an adjusting member can be provided similar to that which acts on the nose-spar rocker shaft 12. It is more expedient to insert, for example by way of a stiff tension spring 29, a traction cable 30 between the base rib 18 (in the vicinity of the knee hinge joint 19) and the projectile body 2; for example, at the bottom 27 of the longitudinal recess 4. The cable 30, upon swinging out of the nose spar 8, draws the two-part base rib 6 rearwardly out of an inner receiving space 23, and thereby tensions the knee hinge joint 19. Under certain circumstances, however, the centrifugal force already acting on the inner end 21 of the rear spar 14 can be sufficient, upon rapid swinging out of the nose spar 8 from the longitudinal recess 4, to cause the rear spar 14 to deflect (rotate) rearwardly abouts its hinge pin 16 and to thereby, along with tautening of the covering 7, move the knee hinge joint 19 into its stable extended position. This causes the base rib 18 to hold the spars 8, 14 spread triangularly and thus maintains the covering 7 taut.

Figure 2:
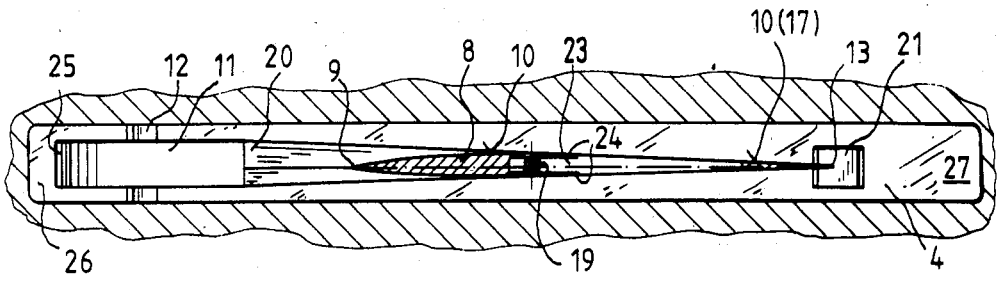
FIG. 2 shows a sectional view taken along line II—II in FIG. 1 in the plane of a base rib knee hinge joint with the rear spar swung in accordance with FIG. 1.

Shown in FIG. 1 in phantom lines is also the position of the rear spar 14 pivoted against the rear of nose spar 8; in effect, the position of the base rib 18 shown retracted (folded in). From this retracted position, the nose spar 8 can be pivoted backwardly behind the peripheral boundary of the outer wall 3 of the projectile and, along with the retraction of the covering 7 into the longitudinal recess 4; part of the base rib 18 together with knee hinge joint 19 and part of the rear spar 14 extend into the rear of the nose spar 8. In order to receive this part of rib 18 and spar 14, the rear region 22 of spar 8 is provided with a rearwardly open U-shaped cross-section, as is evident from FIG. 2. The inner space 23 defined by region 22 serves to receive those upwardly pivoted parts of the strut arrangement 6, the legs 24 of the U-shape externally determine as the wing surfaces 10 the shape adopted by the covering 7 when the wing 5 is pivoted outwardly.

A detent for the inner end 21 of the rearwardly pivoted rear spar 14 can be provided in the rearward region of the longitudinal recess 4, proximate the outer wall 3, through which detent there can be limited the outward (extension) movement of the nose spar 8; such that irrespective of the oncoming airflow factors, there is ensured a predefined inclination of the wing leading edge 9 relative to the peripheral surface of the projectile body 2. Alternatively, it may be even simpler, as is shown in FIG. 1, to provide a supporting shoulder 25 through the swivel hinge 11 which, in a similar manner, specifically limits the outwardly pivoting movement of the nose spar 8 by abutting against a supporting region 26 on the groove bottom 27.

Figure 3:
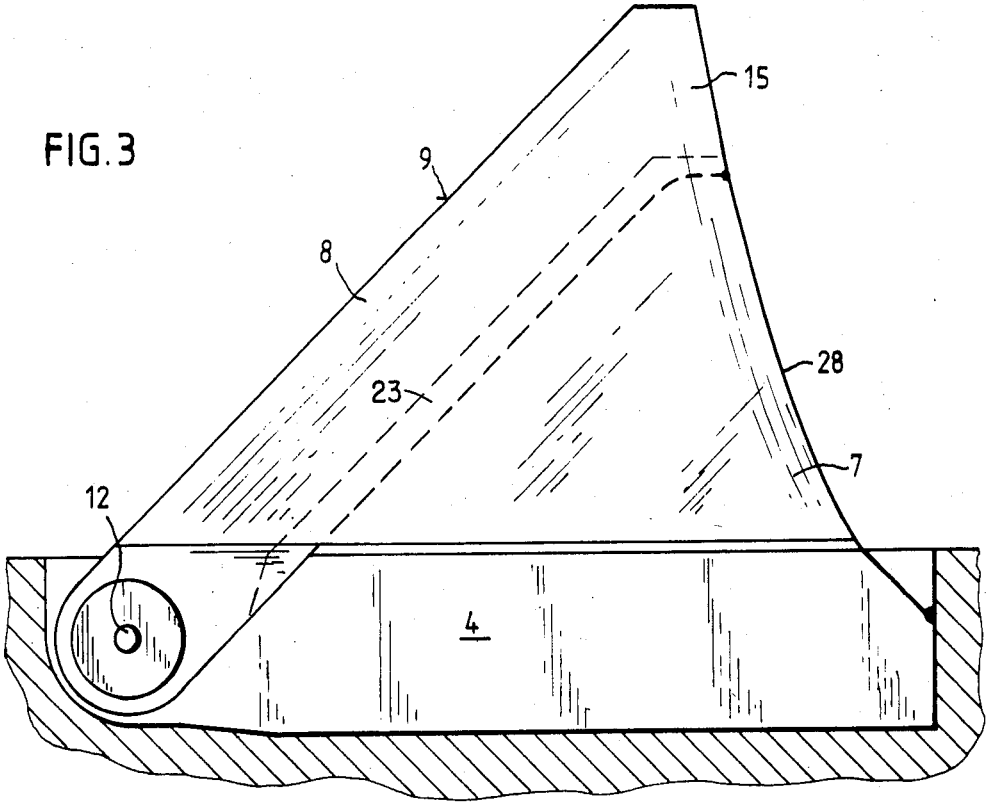
FIG. 3 shows a view similar to FIG. 1, but with the rear spar replaced by a bracing wire.

It may be even simpler and requiring less installation space, when lesser demands are imparted to the tautness of the covering 7 for the outwardly pivoted operational position of the wing 5 by fastening a bracing wire 28 between the nose-spar outer end 15 and the fuselage 2 in the rearward region of the longitudinal recess 4 in order to limit outward movement of the nose spar, as previously mentioned and as shown in FIG. 3. As is evident from the cross-sectional illustration in FIG. 2, the thickness of the wing 5 in the region of its trailing edge 13 is always very narrow and also, since usually for aerodynamic reasons, the rearward wing surface 17 in contrast with the front wing surface 10 may not need to be specially profiled in a defined manner, the bracing wire 28 can then also serve for rearward fixing of the covering 7, and in effect, as shown in FIG. 3 completely replace a rear spar (14 in FIG. 1/FIG. 2) which would need to be separately hinged to the nose spar. The bracing wire 28, which is folded into the hollow or inner receiving space 23 formed in the nose spar 8, similar to that in FIG. 1, when the spar is in the retracted position, is pulled taut by a torsional force acting on the nose-spar rocker shaft 12 when the wing 5 is pivoted outwardly. However, the wire 28 is not pulled straight but into approximately the drawn exponential curve, when the covering 7 is uniformly tautened in the flow direction over the entire span which is under tension.

In a similar manner to the hinging of the rear spar 14 to the outer end 15 of the nose spar 8 by means of a hinge pin 16, in accordance with FIG. 4 the strut arrangement 6 is provided, instead of a knee-joint base rib, with a unitary rigid rocker arm 38 which is hinged to an inner end 20 of the nose spar 8 through a hinge pin 60. In the retracted (folded-up position of the strut arrangement 6, both the rocker arm 38 and the rear spar 14 lie within the inner space 23 which opens in a direction away from the wing leading edge 9, in effect, opens rearwardly. Space 23 is located in the rearward region 22 of the nose spar 8 and is bounded by wing surface 10 in the manner of U-legs 24. The free rear end 39 of the rocker arm 38, located remote from the hinge pin 60, contacts against the base 40 of the groove-shaped inner space 23. Pivoted in therebehind is the rear spar 14. Spar 14 is embraced on both sides by the U-profile 41 of the retracted rocker arm 38, and inner end 21 of spar 14 projects through a slot 42 (FIG. 5), in the direction of the wing leading edge 9, further into the inner space 23.

For effecting the extension of the wing 5, in effect, the outward pivoting of the strut arrangement 6, a traction cable 30 which is fastened to the projectile body (not shown), acts in the region of the rear end 39 on the rocker arm 38, when the nose spar 8 is pivoted from its retracted-in (folded) inoperative position parallel to the longitudinal axis of the projectile body, and thereby into an operational position. In this manner, rocker arm 38 is drawn at its free end 39 rearwardly out of the nose spar inner space 23, in essence pivoted rearwardly about its hinge pin 16 into parallel with the longitudinal axis of the projectile body. Further, in the region of the rocker arm end 39, the leading or front edge 43 of U-member 44 engages the front edge 45 of the rear spar 14 and thereby also forces spar 14 out of the rearwardly opening inner space 23 of the nose spar, along with an accompanying pivoting movement about the hinge pin 16. In this manner, the yoke edge 43 of the rocker-arm end 39 carries out a movement along the rear spar edge 45 in the direction of the inner end 21 thereof and towards the projectile body.

During the course of this outward pivoting (extending movement of spar 14), there must be overcome an elastic resistance which is produced through the tensioning of the covering between the nose-spar front edge 9 and the rear-spar rear edge 13, and this resistance increases with the tautening of the covering. The covering is looped around the nose spar 8 in a recess 56 with the same depth as the covering thickness. In this manner there is ensured that the edge 43 will, during this tightening procedure, at all times abut in a force-fitted engagement against the rear spar edge 45. In addition, the effective distance between the rocker arm hinge pin 60 and the rear spar edge 45 in the vicinity of the inner end 21 thereof can be reduced by an anteriorly curved projection 46 (shown on an enlarged scale). Opposite projection 46, adjacent to the rear spar hinge pin 16, the inner edge 45 has a bevel 47 facing the retracted rocker arm front end 39 (FIG. 4), in order to, at the start of the deflecting movement and upon abutment of the profile edge 43, attain more favorable force-producing levering ratios.

In the region of the end 21, the profiled edge 43 engages in a form-fitting (or snap-fit) manner into a notch 48 in the projection 46, in which the notch extends somewhat inclined oppositely to the forward direction of the edge 43 in order to assist in providing a secure detent connection; whereby yoke 44 extends somewhat in front of its edge 43 at the same inclination. Thus, the wing strut arrangement in the extended condition, in effect, with the covering being taut, is reliably locked, because the taut covering forces the rear spar 14 with this notch 48 in a force-locking manner against the profiled front edge 43.

As shown, the side walls 49 of the U-profile 41 of the rocker arm 38 protrudes beyond the yoke edge 43 in order to ensure, during the displacement of the edge 43 along the rear-spar frontward edge 45, a lateral guidance and to produce in the engaged and tightened position (FIG. 5), an additional lateral rigidity at the transition between the base rocker arm 38 and the rear spar 14.

The rear spar 14, when moved into the retracted (folded) position between the U-legs 49 is preferably also of U-profile shape 50 in cross-section, between the legs 51 of which there are disposed stiffening ribs 52 which extend transversely of the longitudinal direction; this representing a construction which is both lightweight while highly resistant to distortion. The yoke 53, as shown in FIG. 4, is preferably rounded off at the outside in order to ensure that the covering conducted thereabout is not damaged by any sharp edges. Moreover, any overstressing of the covering is avoided in that the rearward pivoting movement of the rear spar 14 is additionally limited by an abutment shoulder 54 on the outer end 55 of the rear spar 14 in the region of the nose spar outlet end 15. However, the effect thereof, which limits the deflecting movement, only occurs when after the covering has been tautened in the locking notch 48, there should occur any further extending movement of the rear spar 14, for example, due to severe acceleration forces in the longitudinal direction of the body of the projectile.

What is claimed is:

1. A projectile having extendable wings; longitudinal recesses arranged along an outer wall surface of the projectile, said wings being hingedly fastened to said projectile so as to be retractable into said recesses and pivotable outwardly thereof, each of said wings comprising a strut arrangement and a flexible covering tensioned by said strut arrangement upon extension of each wing; an aerodynamically rigid profiled nose spar defining a leading edge encompassed by said covering behind the leading edge of said wing; means hinging the forward end of said nose spar in the forward end of said longitudinal recess so as to be laterally and forwardly unfoldable out of the recess; said nose spar having a trailing edge having rearwardly opening space therein; a rigid rear spar at least partly receivable in said rearwardly opening space; and means hinging said rear spar to said nose spar; a base rib extending along the longitudinal direction of the projectile between an inner end of the nose spar and an inner end of the rear spar proximate the surface of the projectile in the extended position of the wing, said rib being subdivided by a knee hinge joint.

2. A projectile as claimed in claim 1, in which the covering also encompasses said rear spar, said rear spar being aerodynamically profiled and hinged to an outwardly extending end of the nose spar in an extended condition of the wing.

3. A projectile as claimed in claim 1, in which the covering encompasses the base rib.

4. A projectile as claimed in claim 1, wherein the rearwardly opening space of the nose spar receives at least a part of the base rib with the knee hinge joint.

5. A projectile as claimed in claim 1, wherein a traction cable is secured so as to extend between the base rib and the projectile.

6. A projectile having extendable wings; longitudinal recesses arranged along an outer wall surface of the projectile, said wings being hingedly fastened to said projectile so as to be retractable into said recesses and pivotable outwardly thereof, each of said wings comprising a strut arrangement and a flexible covering tensioned by said strut arrangement upon extension of each wing; an aerodynamically rigid profiled nose spar defining a leading edge encompassed by said covering behind the leading edge of said wing; means hinging the forward end of said nose spar in the forward end of said longitudinal recess so as to be laterally and forwardly unfoldable out of the recess; said nose spar having a trailing edge having a rearwardly opening space therein; a rigid rear spar at least partly receivable in said rearwardly opening space; and means hinging said rear spar to said nose spar; a base strut forming a rigid rocker arm having a leading end hinged so as to have a trailing end of the arm displaceable along the front edge of the rear spar from the outwardly pivotable end of the rear spar towards the inner end of said rear spar upon outward pivoting of the strut arrangement during extending of the wing.

7. A projectile as claimed in claim 6, wherein the inner end of said rear spar had a detent notch on the front edge for latching engagement with a rear edge of the rocker arm.

8. A projectile as claimed in claim 7, wherein the rear edge of the rocker arm is a U-profiled yoke edge including profiled side walls which straddle the rear spar behind the yoke edge.

9. A projectile as claimed in claim 7, wherein the rear-spar edge is equipped in the region of its inner end thereof with an anterior curved projection in which there is formed said detent notch for the rocker arm edge.

10. A projectile as claimed in claim 7, wherein the detent notch extends inclined relative to the extent of the rear-spar frontward edge and points towards the outer end thereof.

11. A projectile as claimed in claim 6, wherein the rocker arm is designed as a U-profile in a U-yoke of which, in proximity to the hinging to the nose spar, a slot is provided for the passage of the rear spar inner end when the strut arrangement is folded together.

12. A projectile as claimed in claim 6, wherein the front edge of the rear spar extends forwardly in the direction of the outer end thereof.

13. A projectile as claimed in claim 6, wherein the rear spar is designed as a U-profile, the outwardly rounded yoke of which is remote from the nose spar.

14. A projectile as claimed in claim 13, wherein stiffening ribs are arranged between the side walls of the rear spar.

* * * * *